US005348295A

United States Patent [19]

Phillips

[11] Patent Number: 5,348,295

[45] **Date of Patent: * Sep. 20, 1994**

[54] GOLF PUTTER WITH ADJUSTABLE SHAFT

[76] Inventor: James W. Phillips, 3087 Landmark Blvd., #1804, Palm Harbor, Fla. 34684

[ * ] Notice: The portion of the term of this patent subsequent to Jun. 14, 2011 has been disclaimed.

[21] Appl. No.: 147,718

[22] Filed: Nov. 4, 1993

Related U.S. Application Data

[63] Continuation-in-part of Ser. No. 74,129, Jun. 8, 1993, Pat. No. 5,320,346.

[51] Int. Cl.[5] ..... A63B 53/02; A63B 53/06

[52] U.S. Cl. ..... 273/79; 273/164.1; 273/171; 273/80 C; 273/167 G; 273/80.1

[58] Field of Search ..... 273/80.1-80.9, 273/79, 77 R, 167 F, 169, 171, 167 H, 173, 164.1, 167 G, 80 C; 403/76, 90, 362

[56] References Cited

U.S. PATENT DOCUMENTS

| | | | |
|---|---|---|---|
| 749,174 | 1/1904 | Davis | 273/79 |
| 1,352,020 | 9/1920 | Olson | 273/79 |
| 1,643,250 | 9/1927 | Longsworth | 273/79 |
| 2,708,579 | 5/1955 | Hugman | 273/80.1 X |
| 3,096,982 | 7/1963 | Bassin | 273/80.1 |
| 3,214,170 | 10/1965 | Warnock | 273/80.1 |
| 3,397,888 | 8/1968 | Springer | 273/80.1 |
| 3,423,089 | 1/1969 | Andis | 273/80.1 |
| 3,448,981 | 6/1969 | Anweiler | 273/167 G X |
| 3,979,123 | 8/1976 | Belmont | 273/171 |
| 4,073,492 | 2/1978 | Taylor | 273/80.2 |
| 4,111,426 | 9/1978 | Goodwin | 273/80.1 X |
| 4,227,694 | 10/1980 | Drake | 273/80 C X |
| 4,569,523 | 2/1986 | Jarvis | 273/171 |
| 4,607,846 | 8/1986 | Perkins | 273/171 |
| 4,621,816 | 11/1986 | Leek | 273/80 C X |
| 4,714,252 | 12/1987 | Rorabeck | 273/171 |
| 4,754,977 | 7/1988 | Sahm | 273/171 |
| 4,815,740 | 3/1989 | Williams | 273/80.1 |
| 4,852,879 | 8/1989 | Collins | 273/164.1 |
| 4,869,507 | 9/1989 | Sahm | 273/171 |
| 4,881,737 | 11/1989 | Mullins | 273/80.1 X |
| 5,050,879 | 9/1991 | Sun | 273/80 |
| 5,116,047 | 5/1992 | Phelan | 273/80.1 |
| 5,121,922 | 6/1992 | Harsh | 273/164.1 |
| 5,226,654 | 7/1993 | Solheim | 273/80 C X |
| 5,244,205 | 9/1993 | Melanson | 273/80.1 X |

*Primary Examiner*—Sebastiano Passaniti

*Attorney, Agent, or Firm*—Herbert W. Larson; James E. Larson

[57] ABSTRACT

A golf shaft is attached to a removable sphere at a first end portion in the shaft. The sphere is mounted within a pocket of a top portion of a putter head and seats within a first or second cavity in a bottom portion of the putter head when the top and bottom portions of the putter head are joined. Set screws located in the bottom portion of the putter head retain the sphere and half spheres, located in a middle cavity and either the first or second cavity in the bottom portion, seated in place. Retraction of the set screws to the sphere permits movement of the shaft so that its angle with respect to the putter head can be adjusted.

15 Claims, 4 Drawing Sheets

GOLF PUTTER WITH ADJUSTABLE SHAFT

PRIOR APPLICATIONS

This application is a continuation-in-part of Ser. No. 08/074,129, filed Jun. 8, 1993 now U.S. Pat. No. 5,320,346.

BACKGROUND OF THE INVENTION

1. Field of The Invention

This invention relates to a golf putter. More particularly, it relates to a golf putter with an adjustable shaft to adjust the angle of the shaft with respect to the putter head and a variable weight distributing putter head.

2. Description of Prior Art

The principal of adding weights to putter heads and providing a means to transfer the shaft connection in the putter head to accommodate either a right handed or left handed golfer is well known as seen from U.S. Pat. Nos. 3,397,888, 5,116,047 and 5,121,922.

In U.S. Pat. No. 3,397,888, a golf club has a shaft which can be inserted into a hole selected from a linear row of holes on two separate surfaces of the club head. This permits the use of the club by either a right or left handed golfer and provides for selection from two different golf faces for use in striking a golf ball.

In U.S. Pat. No. 5,116,047, the putter head has three threaded holes so that an end of the golf shaft can be locked in place in any one of the holes to permit use of the putter for either a right handed or left handed golfer. In addition, two weights can be added to the putter head.

In U.S. Pat. No. 5,121,922, there is a rearwardly extending head portion containing weights to alter the center of gravity of the putter head.

While the putters in the prior art patents are useful for their intended purpose, golfers are continuously on the look out for improved putters which will enhance their putting skills. Such an improved putter is the subject of the present invention.

SUMMARY OF THE INVENTION

I have invented a putter which can be used by either a right or left handed golfer, can be easily adjusted to vary the angle between the golf shaft and head, and contains the proper weight balancing element to provide a smooth putting stroke.

My adjustable golf putter has an offset in its shaft proximal to the putter head. An alternate configuration of my adjustable golf putter has a straight shaft. A removable sphere is attached at the end of the shaft and is mountable within a pocket located in the putter head. Set screws retain the sphere in place. By simply retracting the screws, the sphere is moved to change the angle of the shaft with respect to the putter head. Half spheres are placed in cavities in the putter head to balance the weight of the sphere attached to the shaft.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
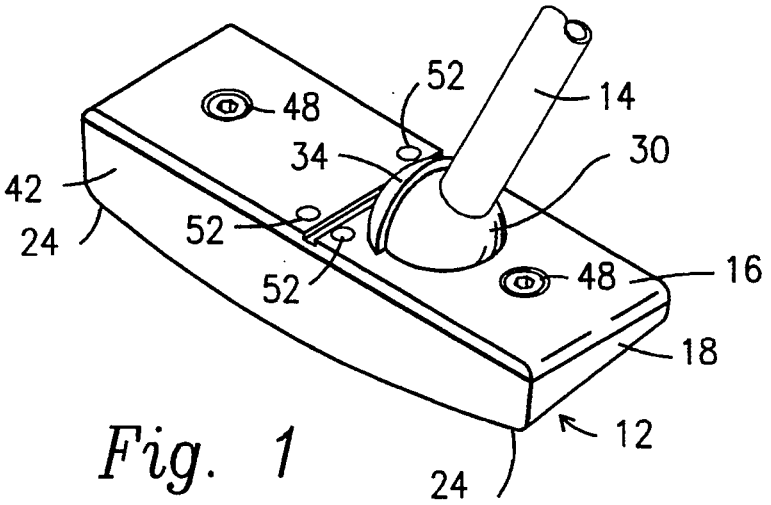
FIG. 1 is a perspective view of the putter head and shaft end engaging the putter head.

Throughout the following detailed description, the same reference numerals refer to the same elements in all figures.

Figure 2:
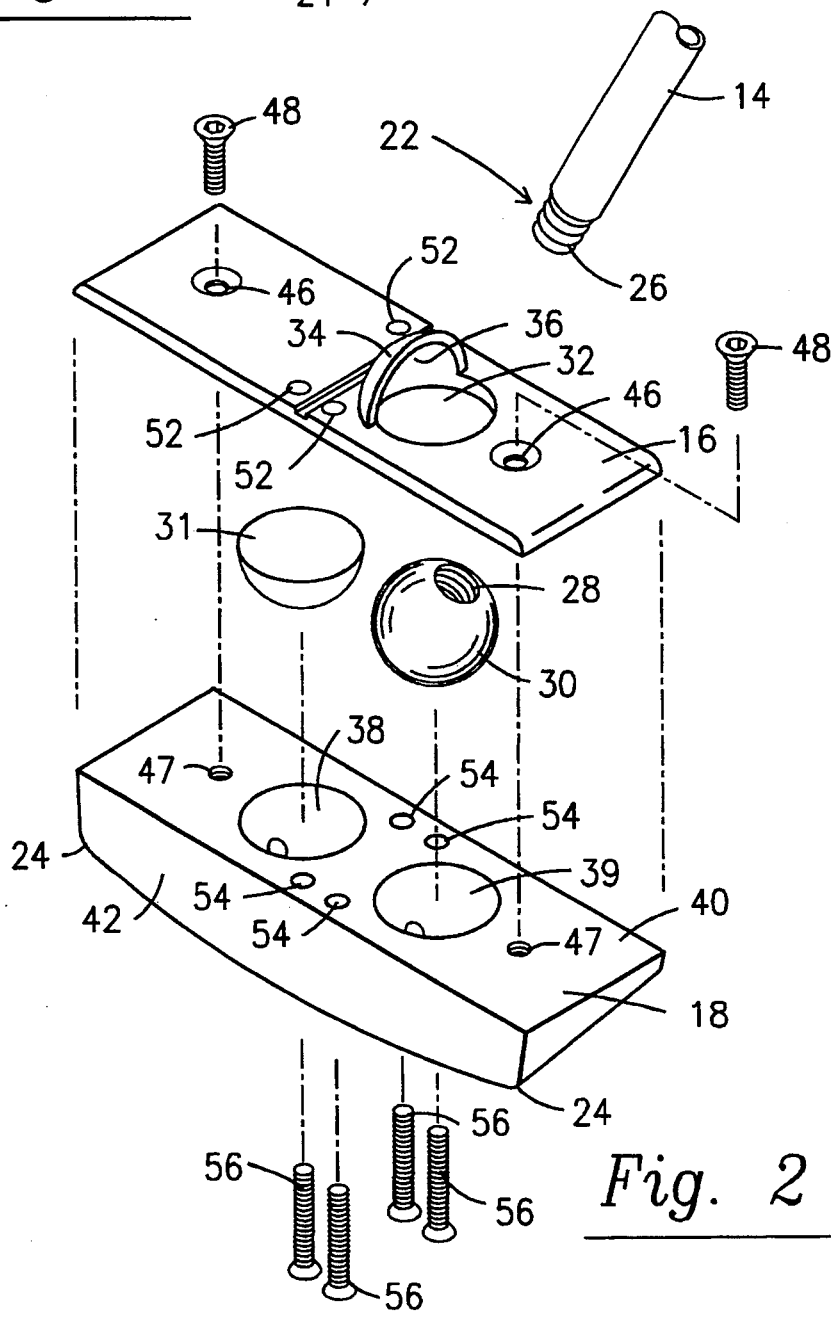
FIG. 2 is an exploded perspective view of the putter head and shaft end.
Figure 5:
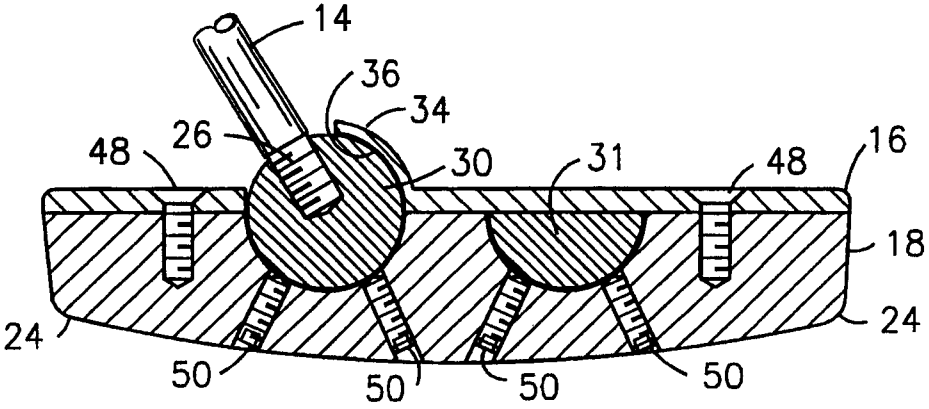
FIG. 5 is a side view in section of the putter head with the handle set for a left handed configuration.
Figure 6:
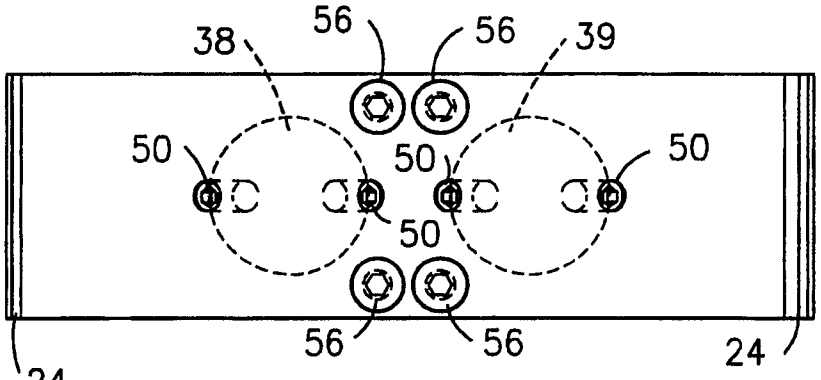
FIG. 6 is a bottom plan view of the bottom portion of the putter head.
Figure 3:
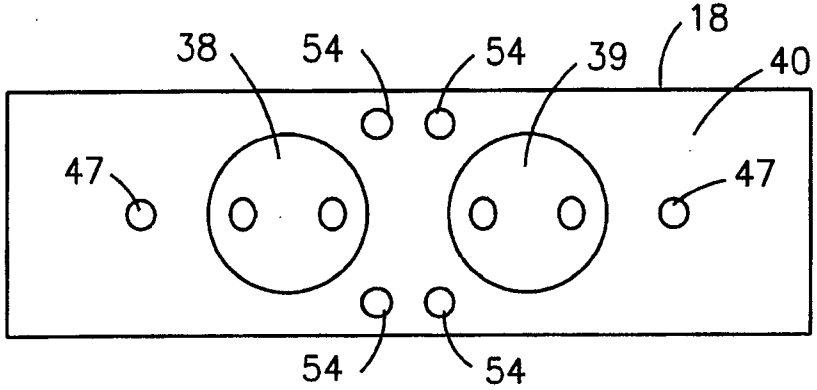
FIG. 3 is a top plan view of the bottom portion of the putter head.
Figure 4:
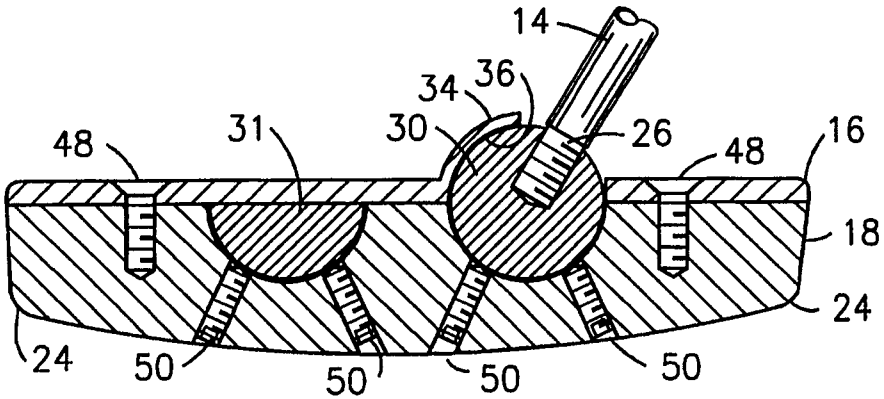
FIG. 4 is a side view in section of the putter head with the handle set for a right handed configuration.
Figure 7:
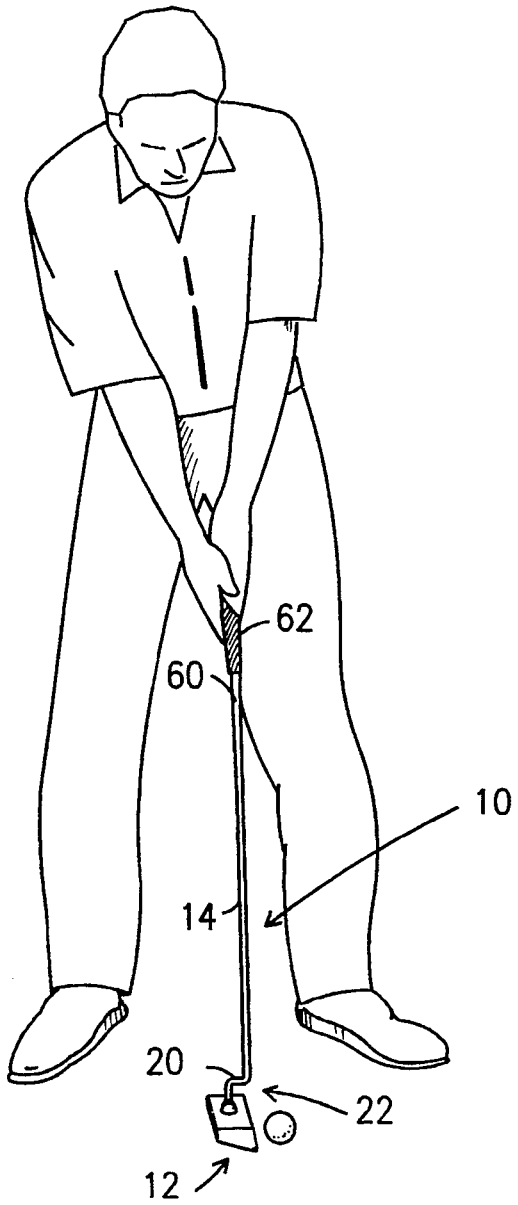
FIG. 7 is a perspective view of a right handed golfer using the adjustable golf putter.
Figure 8:
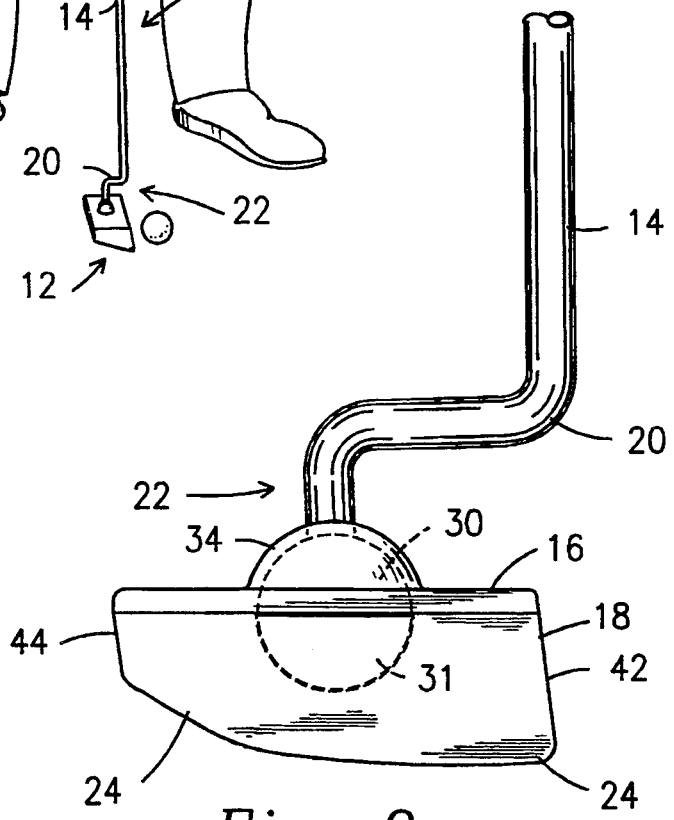
FIG. 8 is a front end view of the putter head showing the sphere in phantom.

A golf putter 10, as shown in FIG. 7, has a putter head 12 and a shaft 14 as shown in FIG. 1. Putter head 12 has a top portion 16 and a bottom portion 18, as shown in FIG. 2. Shaft 14 has an offset 20, as shown in FIG. 8, at a first end portion 22 proximal to putter head 12. A threaded shank 26 axially extends from the first end portion 22 of shaft 14 and engages with a threaded bore 28 of a removable sphere 30, as shown in FIGS. 4 and 5.

Top portion 16 of putter head 12 has an aperture 32 with an arcuate partial housing 34 extending over aperture 32 forming a pocket 36, as shown in FIG. 2. Pocket 36 prohibits removable sphere 30 from disengaging from top portion 16 of putter head 12, as shown in FIG. 1.

Bottom portion 18 of putter head 12 has a pair of cavities 38 and 39 respectively on a top surface 40, as shown in FIG. 2. Removable sphere 30 rests in one of the cavities 38 or 39 depending on the dominant hand of a golfer and the relative position of a striker face 42 in putter head 12. Striker face 42 is identified as the plate with the larger surface area compared to a back plate 44. Both striker face 42 and back plate 44 have curved edges 24 at their respective ends.

For a right handed golfer, removable sphere 30 rests in cavity 39 proximal to the golfer when striker face 42 is to the left of the cavity 39. For a left handed golfer, removable sphere 30 rests in cavity 38 proximal to the golfer when striker face 42 is to the right of cavity 38. The positioning of sphere 30 in cavity 38 or 39 and the resulting angle of shaft 14 extending from putter head 12 is determined by the golfer on an individual basis. The remaining cavity 38 or 39 is filled with a removable half sphere 31, as shown in FIG. 2, and acts as a counter balance distributing weight through putter head 12, thereby bringing the center of gravity to the middle of putter head 12.

Top portion 16 and bottom portion 18 respectively of putter head 12 have a plurality of axially aligned large tapped bores 46 and 47 respectively for receiving screws 48 locking top portion 16 and bottom portion 18 together forming putter head 12, as shown in FIG. 2. Smaller tapped bores 52 in top portion 16 axially align with bores 54 in bottom portion 18, and screws 56 engaged from the bottom of bottom portion 18 also assist in attaching top portion 16 to bottom portion 18 forming putter head 12. Multiple set screws 50 in bottom portion 18 hold sphere 30 and half sphere 31 in place, as shown in FIGS. 4 and 5.

Figure 9:
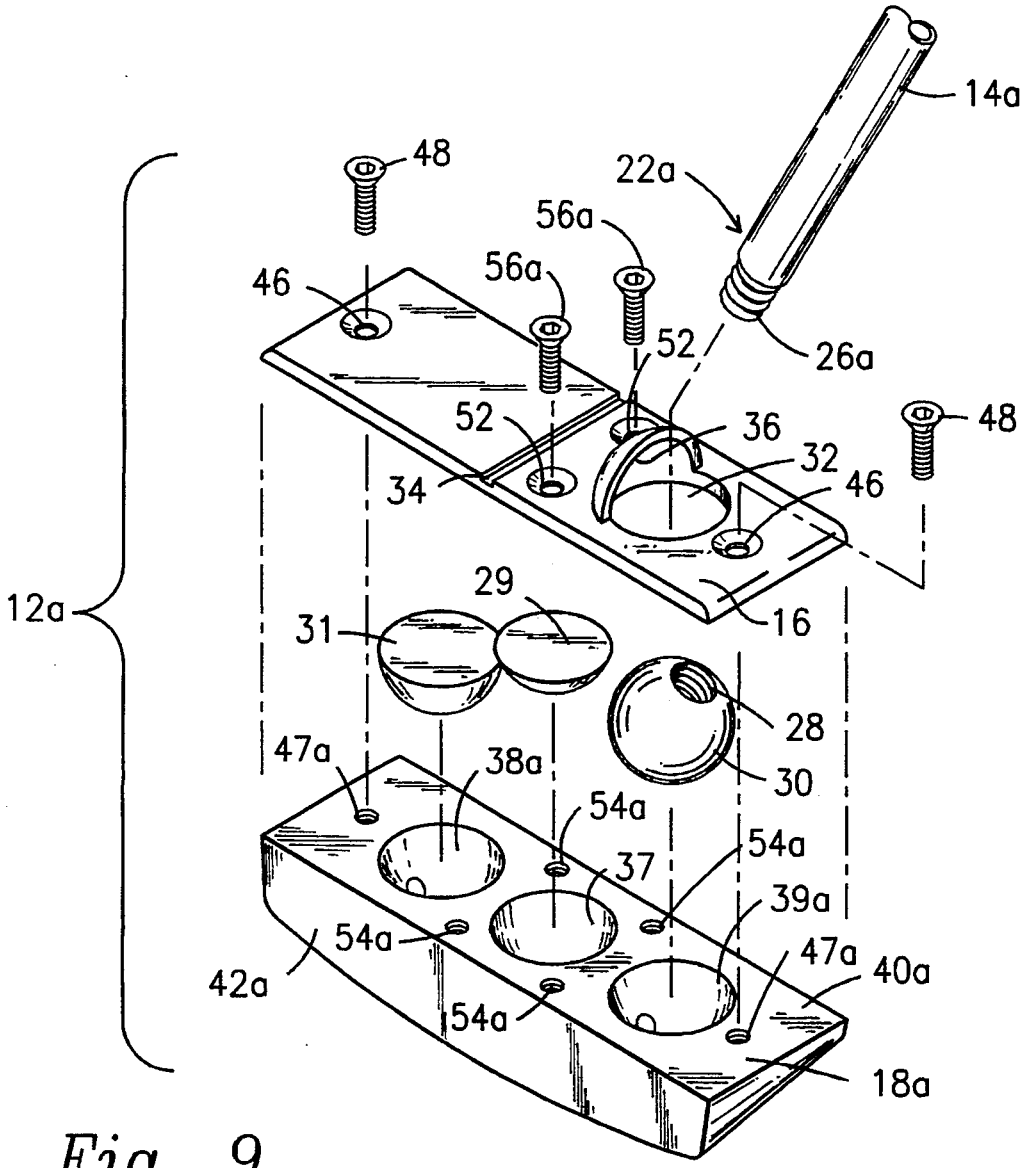
FIG. 9 is an alternate embodiment exploded perspective view of the putter head and straight shaft end.
Figure 10:
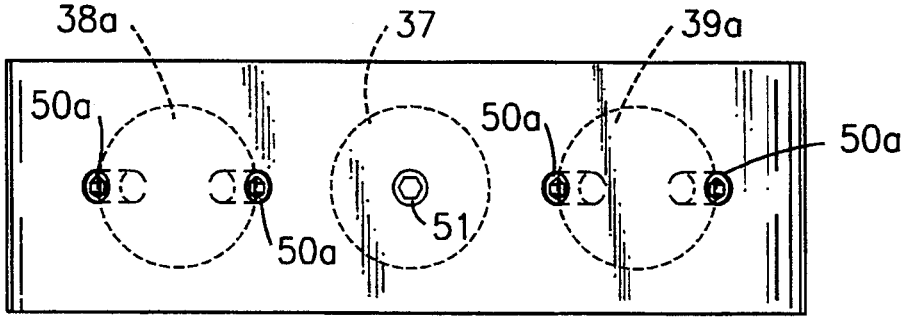
FIG. 10 is an alternate embodiment bottom plan view of the bottom portion of the putter head.

An alternate embodiment of the invention is shown in FIGS. 9 and 10. A putter head 12*a* has a top portion 16, a bottom portion 18*a*, and a shaft 14*a*, as shown in FIG. 9. Shaft 14*a* is straight. A threaded shank 26*a* axially extends from a first end portion 22*a* of shaft 14*a* and engages with a threaded bore 28 of a removable sphere 30.

Top portion 16 of putter head 12*a* has an aperture 32 with an arcuate partial housing 34 extending over aperture 32 forming a pocket 36, as shown in FIG. 9. Pocket 36 prohibits removable sphere 30 from disengaging from top portion 16 of putter head 12*a*.

Bottom portion 18*a* of putter head 12*a* has three cavities 37, 38*a*, and 39*a* respectively on a top surface 40*a*, as shown in FIG. 9. Removable sphere 30 rests either in cavity 38*a* or 39*a* depending on the dominant hand of a golfer and the relative position of a striker face 42*a* in putter head 12*a*. For a right handed golfer, removable sphere 30 rests in cavity 39*a* proximal to the golfer when striker face 42*a* is to the left of cavity 39*a*. For a left handed golfer, removable sphere 30 rests in cavity 38*a* proximal to the golfer when striker face 42*a* is to the right of cavity 38*a*. The positioning of sphere 30 in cavity 38*a* or 39*a* and the resulting angle of shaft 14*a* extending from putter head 12*a* is determined by golfer preference on an individual basis. Once cavity 38*a* or 39*a* is filled with sphere 30, remaining cavities 37 and 38*a* or 39*a* are filled with removable half spheres 29 and 31 respectively, as shown in FIG. 9, and act as counter balance distributing weights through putter head 12*a*, thereby bringing the center of gravity to the middle of putter head 12*a*.

Top portion 16 and bottom portion 18*a* of putter head 12*a* have a plurality of axially aligned large tapped bores 46 and 47*a* respectively for receiving screws 48, locking top portion 16 and bottom portion 18*a* together, forming putter head 12*a*, as shown in FIG. 9. Smaller tapped bores 52 in top portion 16 axially align with bores 54*a* in bottom portion 18*a*. Screws 56*a* engage from the top of top portion 16 and assist in attaching top portion 16 to bottom portion 18*a* forming putter head 12*a*. As shown in FIG. 10, multiple set screws 50*a* in bottom portion 18*a* are angled and hold sphere 30 and half sphere 31 in place, while set screw 51 is perpendicular with respect to the horizontal plane of the bottom portion top surface 40*a*, and holds half sphere 29 in place.

A second end 60 of shaft 14 and 14*a* has a rubberized grip 62 attached. Shaft 14 and 14*a* can be made of aluminum, steel or graphite. Head 12 and 12*a* are made of steel as are sphere 30 and half spheres 29 and 31. Offset shaft 14 or straight shaft 14*a* could be used with either embodiment disclosed herein.

The putter 10 is supplied with six half spheres 29 and 31, two weighing one quarter ounce, two weighing one half ounce, and two weighing three quarters of an ounce.

Equivalent elements can be substituted for the ones set forth above to achieve the same results in the same manner.

Having thus described the invention what is claimed and desired to be secured by Letters Patent is:

1. A golf putter with a shaft attached to a weighted putter head comprising, the putter head having a top and bottom portion, the bottom portion containing at least three cavities in a top surface, a plurality of bores in the putter head top and bottom portions axially aligned for receipt of screws to join the top and bottom portions together, a removable sphere having a bore, the sphere attached to a first end portion of the shaft movably mounted within a pocket of the putter head top portion and seated in a cavity in the putter head bottom portion when the top and bottom portion are joined, and at least two removable half spheres inserted in at least two cavities so that a balance of weight distribution is achieved in the putter head.

2. The golf putter according to claim 1, wherein the putter head bottom portion contains a first, second, and middle cavity in the top surface.

3. The golf putter according to claim 2, wherein the removable sphere rests in the first cavity, a first removable half sphere rests in the second cavity, and a second removable half sphere rests in the middle cavity, the removable sphere and first removable half sphere being reversible in their respective cavities to permit the golf putter to be used by either a right handed or left handed golfer.

4. The golf putter according to claim 1 wherein set screws mounted within a bottom surface of the bottom portion of the putter head fixedly seat the sphere and half spheres in place within the cavities.

5. The golf putter according to claim 1, wherein a threaded shank at the first end portion of the shaft engages with threads within the removable sphere bore.

6. The golf putter according to claim 1 wherein the pocket of the putter head top portion is formed by an arcuate raised surface of the top portion together with an aperture therein, the aperture having a diameter smaller than the diameter of the removable sphere.

7. The golf putter according to claim 1, wherein the shaft has an offset, the offset consisting of two right angled turns in the shaft so that the first end portion of the shaft below the offset is parallel to the direction of an upper portion of the shaft above the offset.

8. The golf putter according to claim 7, wherein the upper portion of the shaft in mounted over a striker face of the putter.

9. The golf putter according to claim 1, wherein the shaft is straight.

10. The golf putter according to claim 1, wherein removable half spheres of varying weight and size are replaceable so that a wide selection of weighted putter heads are available to the golfer.

11. A golf putter with a shaft attached to a weighted putter head comprising, the putter head having a top and bottom portion, the bottom portion containing a first, second, and middle cavity in a top surface, a plurality of bores in the putter head top and bottom portions axially aligned for receipt of screws to join the top and bottom portions together, a removable sphere having a threaded bore, the shaft having a threaded shank at a first end portion engaging the threaded bore of the sphere, the sphere movably mounted within a pocket of the putter head top portion and seated in the first cavity of the putter head bottom portion when the top and bottom portions are joined, the pocket in the top portion formed by an arcuate raised surface of the top portion together with an aperture therein, the aperture having a diameter smaller than the diameter of the removable sphere, a first removable half sphere resting in the second cavity and a second removable half sphere resting in the middle cavity so that a balance of weight distribution is achieved in the putter head, the first removable half sphere being reversible with the removable sphere in their respective cavities to permit the golf putter to be used by either a right handed or left handed golfer, and a plurality of set screws mounted within a bottom surface of the bottom portion of the putter head fixedly seating the sphere and half spheres in place within their respective cavities.

12. The golf putter according to claim 11, wherein the shaft has an offset, the offset consisting of two right angled turns in the shaft so that the first end portion of the shaft below the offset is parallel to the direction of an upper portion of the shaft above the offset.

13. The golf putter according to claim 12, wherein the upper portion of the shaft in mounted over a striker face of the putter.

14. The golf putter according to claim 11, wherein the shaft is straight.

15. The golf putter according to claim 11, wherein removable half spheres of varying weight and size are replaceable so that a wide selection of weighted putter heads are available to the golfer

* * * * *